US006170823B1

(12) United States Patent
Kintner

(10) Patent No.: US 6,170,823 B1
(45) Date of Patent: Jan. 9, 2001

(54) CATENA BOARD GAME

(76) Inventor: Robert J. Kintner, 23 S. Washington St., Port Washington, NY (US) 11050

( * ) Notice: Under 35 U.S.C. 154(b), the term of this patent shall be extended for 0 days.

(21) Appl. No.: 09/376,778

(22) Filed: Aug. 17, 1999

(51) Int. Cl.[7] ..... A63F 3/00

(52) U.S. Cl. ..... 273/236; 273/293; D21/16

(58) Field of Search ..... 273/236, 269, 273/139, 138

(56) References Cited

U.S. PATENT DOCUMENTS

| | | | | |
|---|---|---|---|---|
| D. 57,994 | | 5/1921 | Samuel . | |
| D. 138,177 | * | 7/1944 | Field | D34/13 |
| D. 256,481 | * | 8/1980 | Zemby | D21/16 |
| 550,584 | | 12/1895 | Bristow . | |
| 1,519,422 | | 12/1924 | Taylor . | |
| 2,082,983 | * | 6/1937 | Shaffer | 273/131 |
| 2,766,987 | | 10/1956 | Seelbrede et al. . | |
| 3,618,952 | * | 11/1971 | Tallarida | 273/135 B |
| 4,146,233 | * | 3/1979 | Musolino | 273/236 |
| 4,302,015 | * | 11/1981 | Bowser et al. | 273/271 |
| 5,037,110 | * | 8/1991 | Haskel | 273/293 |
| 5,100,139 | * | 3/1992 | Di Bella | 273/138 R |
| 5,613,682 | | 3/1997 | Otuzbiryan . | |

OTHER PUBLICATIONS

GAMES, Aug. 2000, p. 56.

* cited by examiner

*Primary Examiner*—Jeanette Chapman
*Assistant Examiner*—Dolores R. Collins
(74) *Attorney, Agent, or Firm*—Collard & Roe, P.C.

(57) ABSTRACT

A board game and method of playing a board game is provided. The game has at least pieces representing the fifty-two cards in a standard playing card deck and at least four wild cards arranged in the standard playing card suits, at least one wild card for each suit. A game board is provided having a flat playing surface of rectangular dimension arranged in four columns, one for each card suit. Each column has fourteen squares for placement of the pieces. A plurality of racks holds at least five of the pieces, one rack for each game player. The game is played by having each player, in clockwise rotation, place at least one piece in an open board square having the same suit as the suit on the piece. Up to five pieces may be placed in open board squares per turn to form either three or four of a kind or three or more of a run in a straight line horizontally, vertically or diagonally. Points are awarded as follows: each ace card piece has a value of twenty points when used as an ace or placed after a king card piece and a value of one point when placed before a two card piece; each face card piece has a value of ten points; each numbered card has its indicated value; and each wild card has no value.

4 Claims, 2 Drawing Sheets

CATENA BOARD GAME

BACKGROUND OF THE INVENTION

1. Field of the Invention

The present invention relates to board games and more particularly to a "Catena" board game in which players connect three or more card pieces in a straight line horizontally, vertically or diagonally to score points.

2. The Prior Art

At the present time there are a large variety of games involving numbered cards or blocks. For example, one type of game using numbered blocks is shown in U.S. Pat. No. 550,584 to Bristow wherein forty blocks are arranged in four suits of ten blocks each, each suit bearing numerals 1, 2, 3, 4, 5, 6, 7, 8, 9 and 0, with "1" being low and "0" being high. The game is played by laying down three or more blocks of either the same number, for example "666," or consecutive numbers of the same color, for example, "1234."

In Otuzbiryan U.S. Pat. No. 5,613,682, a card game uses a conventional deck of cards with the numbered cards 2–6 removed and one joker added as a wild card. Each card has an assigned value which is scored only when combined with other cards of the same suit (as in a flush) or with other cards of the same kind (as in three jacks). The object of the game is for each player to select three or four cards dealt in a turn in order to come up with the highest point value for the turn.

The Seelbrede et al U.S. Pat. No. 2,766,987 shows a board game using cards and pegs. The game board is square, with each of the four sides of the board having a different color corresponding to a game player. Each card bears a letter of the alphabet and a color corresponding to a game player, four sets of twenty-six such letter cards of each color being used in the game. The game is played by placing pegs (of the color assigned to the particular player) into peg holes in the board corresponding to the color on a card drawn from the card deck. When a player fills the last available hole in any one of the four color areas of the board, he or she is permitted to use the cards he or she has drawn to spell words and to obtain points for the words spelled.

The Taylor U.S. Pat. No. 1,519,422 shows a football-type of board game using the face value of playing cards to determine how far the "football" moves on each play.

Other patents of general interest are Samuel Des. 57,994 and Field Des. 138,177 which show designs for playing cards, depicting a 4×13 grid with the suits arranged in columns and the cards in each suit arranged in rows.

Although at the present time there are a large variety of games involving numbered cards or blocks, there is still a need for a board game which is easy to learn and simple to play and which may be contained in a compact case which also serves as the playing board.

OBJECTIVES AND FEATURES OF THE INVENTION

It is an objective of the present invention to provide a board game involving the use of a 56 square board, at least 56 card pieces, and a particular scoring system.

It is a further objective of the present invention to provide such a game in which the pieces may be formed of an inexpensive material, such as foam board, and yet will remain durable through use.

It is a further feature of the present invention to provide such a game which uses pieces corresponding to the cards in a standard playing card deck.

It is a further objective of the present invention to provide such a game which uses a playing board that may be formed on the interior or exterior surface of a carrying case housing the game materials.

It is a further objective of the present invention to provide such a game in which the object of the game is to form or extend a "Catena" by connecting three or more card pieces in a straight line horizontally, vertically or diagonally.

It is a further objective of the present invention to provide such a game which may be made in reduced "travel size" so that the game may be easily played in cars, trains and airplanes.

It is a further objective of the present invention to provide such a game which may be played with at least two and as many as eight players.

It is a feature of the present invention to provide a board game having at least fifty-six pieces, a game board, and a plurality of racks for holding at least five of the pieces for each game player. The game pieces have indicia representing the fifty-two cards in a standard playing card deck and at least four wild cards arranged in the standard playing card suits, at least one wild card for each suit. The game board has a flat playing surface of rectangular dimension arranged in four columns, one column for each card suit and each column having fourteen squares for placement of the pieces.

The game is played by having each player, in clockwise rotation, place at least one piece in an open board square having the same suit as the suit on the piece being placed. The player may place as many as five pieces in the open board squares to form either three or four of a kind or three or more of a run in a straight line horizontally, vertically or diagonally.

In another embodiment, it is a feature that the board game includes a case for holding the pieces and the racks, with the case, when opened, forming the game board along its top and bottom surface.

SUMMARY OF THE INVENTION

The invention relates to a board game and a method of playing the game among two or more players. The game board has four columns representing each of the four standard playing card suits: spades, diamonds, clubs and hearts. Each column has fourteen squares. At least fifty-six card pieces are provided, one card piece for each card in a standard 52-card deck plus at least four wild card pieces, at least one for each suit. The card pieces are placed in. the column on the board corresponding to the suit of the card piece, but may be played in any of the fourteen squares in that column not already occupied by another card piece. For each turn, a player places one card piece on the board or more than one if the player can form a connection of three or four of a kind or three or more in a run in any direction (vertical, horizontal or diagonal), provided the card piece suit matches the suit column. Points are awarded based on an assigned point value: 20 points for an ace (or one point when placed before a two), 10 points for picture cards, no points for wild cards, and face value for the rest of the cards. A plurality of racks is also provided for holding the card pieces, one rack for each game player, each rack adapted to hold at least five pieces.

Additional details of the invention are contained in the following detailed description and the attached drawings in which preferred embodiments are illustrated by way of example.

BRIEF DESCRIPTION OF THE DRAWINGS

Other objects and features of the present invention become apparent from the following detailed description considered in connection with the accompanying drawings which disclose an embodiment of the present invention. It should be understood, however, that the drawing is designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

The board game of the present invention is called "Catena." Catena in Spanish means a series of connected things. The object of the game is to form or extend a Catena by connecting three or more card pieces or tiles in a straight line horizontally, vertically or diagonally. To form a Catena, the card pieces must be either of the same kind or part of a run, must be played in the same suit column and must be adjacent to other card pieces. Catenas may be formed in as many as four directions with the placement of a single card piece (horizontally, vertically and diagonally—2 ways). Since each card piece has a numerical value, the player that accumulates the most points wins.

Figure 1:
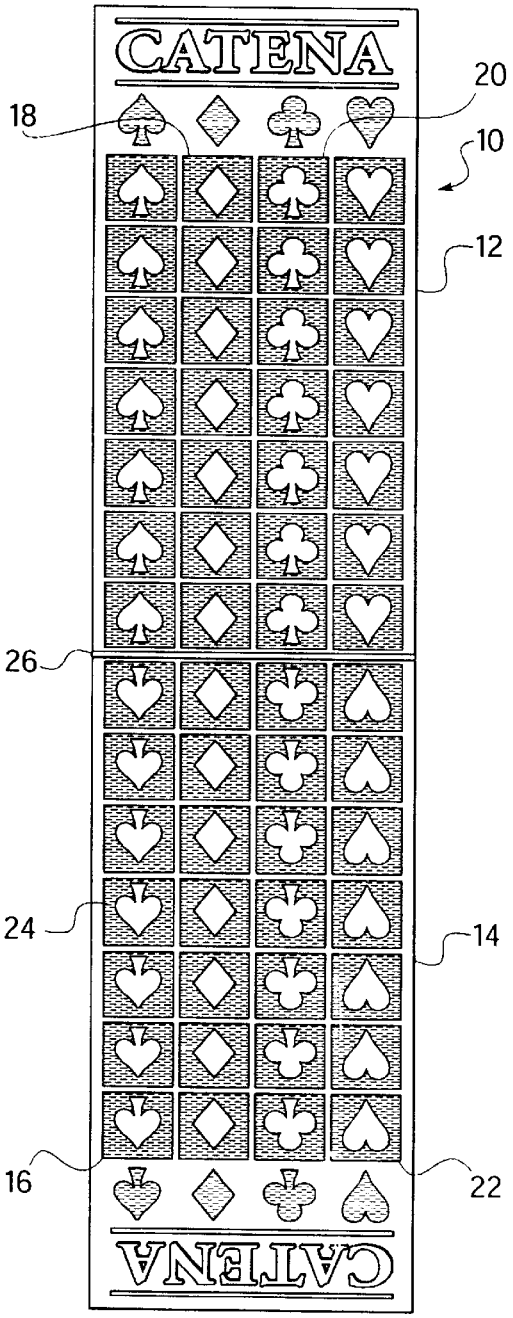
FIG. 1 is a front elevation view of the board incorporated in an embodiment of the present invention.

Turning now in detail to the drawings, FIG. 1 shows a game board 10 for use in playing the game of the present invention. The board is formed as a one-piece unit preferably made from cardboard, foam board or other suitable sturdy material. Alternatively, the board may be formed as two pieces 12, 14, as shown in FIG. 1, adapted to be folded over on top of each other along fold line or hinge 26.

Game board 10 has a flat playing surface of rectangular dimension. Board 10 is arranged in four columns 16, 18, 20, 22, one column for each card suit. Each column has fourteen squares 24 of suitable dimension, for example approximately one inch by one inch, for placement of the card pieces, representative samples of which are shown in FIG. 2.

Preferably game board 10 is designed in compact form. For example, board 10 preferably is 3 to 5 inches in width and 12 to 17 inches in length. However, other dimensions are suitable depending on the preferences of the players.

Figure 5:
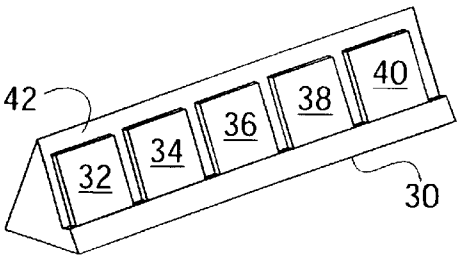
FIG. 5 is a perspective view of a rack holding a plurality of the game pieces of FIG. 2.

A rack 30 for use in playing the game of the present invention is shown in FIG. 5. A plurality of racks 30, preferably two or four, but as many as eight, are provided, one for each game player. Rack 30 is adapted to hold at least five pieces 32, 34, 36, 38, 40 as shown in FIG. 5. Preferably, rack 30 is formed of wood or plastic, and is wedge-shaped with a relatively flat surface 42 for holding pieces 32, 34, 36, 38, 40, preferably at an angle so that the pieces are easily viewed by a game player and concealed from view from the other game players.

Figure 2:
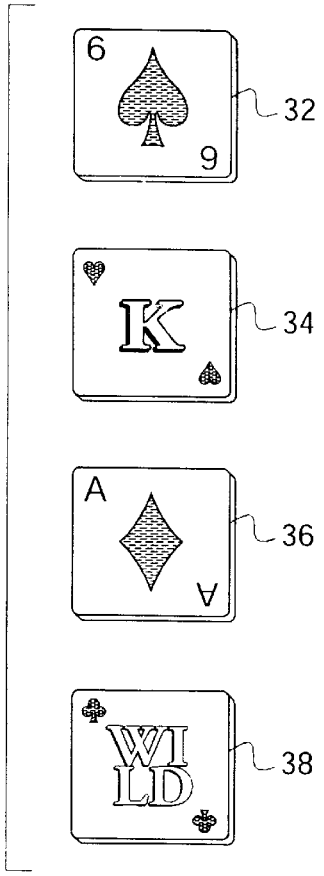
FIG. 2 shows representative game pieces suitably designed for play with the board of FIG. 1.

FIG. 2 shows representative pieces 32, 34, 36, 38 used in playing the game of the invention. As shown in FIG. 2, pieces have imprinted on one side one of the four suits in a standard playing card deck, and the other side blank or imprinted with a common design. Preferably, there is one card piece for each card in a standard deck, plus four wild card pieces, one in each suit. However, there may be more than four wild card pieces and more than fifty-six card pieces. For example, there may be eight wild card pieces, two in each suit, for a total number of sixty card pieces. The card pieces or tiles may be formed from foamboard, wood, plastic or other suitable material. Preferably, the pieces are approximately the same size or slightly smaller than the squares of board 10.

Figure 3:
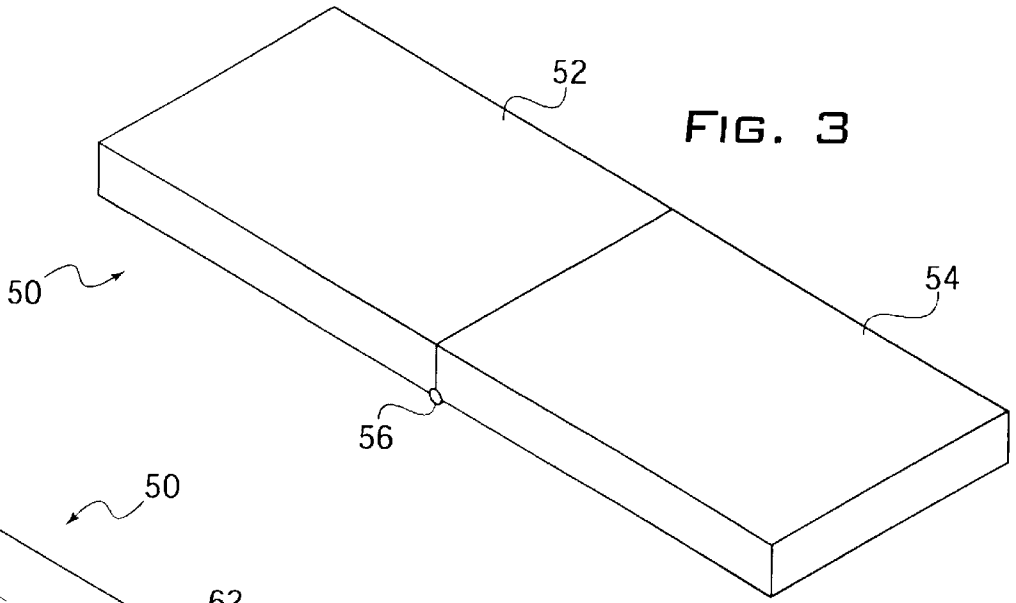
FIG. 3 is a perspective view of a case in accordance with another embodiment of the invention, the case being shown in the opened position.
Figure 4:
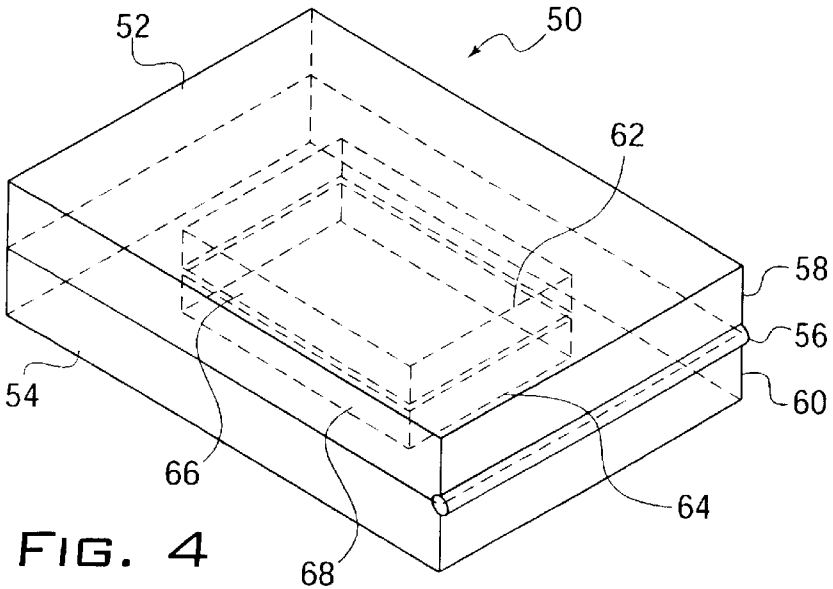
FIG. 4 is a perspective view of the case of FIG. 3 shown in the closed position, with the case partially broken away to show the wells provided in the interior surfaces of the case.

The game of a second embodiment is shown in FIGS. 3 and 4 and comprises a case 50 for holding the pieces and the racks. Case 50 comprises a top surface 52, a bottom surface 54 and a hinge 56 connecting them. FIG. 3 shows case 50 in the open position and FIG. 4 shows case 50 in the closed position. Top and bottom surfaces 52, 54 of case 50 are imprinted with the board game surfaces 12, 14 (see FIG. 1) so that upon opening case 50 along hinge 56, top and bottom surfaces 52, 54 form game board 10.

Case 50 may be made of wood, plastic or other suitable material. Case 50 comprises two rectangular portions 58, 60 connected by hinge 56. Each rectangular portion 58, 60 has an exterior flat surface 52, 54 and a respective interior surface 62, 64 provided with a respective well 66, 68 for holding the game pieces or the racks. For example, well 66 may be designed to hold the game pieces and well 68 may be designed to hold the racks. Exterior flat surface 52 of rectangular portion 58 forms the top surface of case 50 and exterior flat surface 54 forms bottom surface of case 50.

Preferably, to begin the game, the card pieces are placed face down on a surface and mixed up. Alternately, the pieces may be placed in a sack or bag and each player reaches in to remove a piece. Each player selects one card piece. The player with the highest card piece value goes first. Wild card pieces have the lowest value. Each player selects four more card pieces in a clockwise rotation until each player has five card pieces on their rack before them. The newly drawn card pieces are not shown to the other players. No player should know what card pieces the other players have on their rack other than the card piece selected to determine the first player.

If two players should draw a card piece of the same high card piece value, the player with the highest suit will go first. As in standard card games, spades has the highest suit value with hearts, diamonds, and clubs following in that order.

In playing the game, players try to form Catenas using the card pieces they have drawn. The player going first places one card piece in any open space of the appropriate suit. A player can play only one card piece per turn unless he or she can form or extend a Catena.

A player can form a Catena by connecting three or four of a kind or three or more of a run in a straight line in any direction: horizontally, vertically or diagonally. The suit on the card pieces must match the designated suit of the columns and the card pieces must be adjacent to the other card pieces.

Only one Catena can be formed per turn, unless the card pieces played to form one Catena happen to form or extend another Catena.

A player can build an existing Catena by placing a card piece of the same kind or one that is part of an existing run in an open adjacent square or squares. The card pieces must be part of one Catena. However, the card pieces played to form or build one Catena can form or build other Catenas. The player receives the point count of all Catenas formed or built by the play, including the previously played card pieces.

One aspect of the game involves blocking other players from making Catenas. To block a Catena, a player can place an out of sequence card piece. For example, if a run exists on the board of 9, 10, jack and queen of diamonds with open squares next to the queen and 9, by placing a 2 of diamonds next to the queen of diamonds the Catena is blocked in that direction. Meanwhile, the Catena would continue to be open next to the 9.

A player may have more than one card piece that would be part of the same run. The player can elect to play one piece per turn. For example, if there is a run from 8 to jack in the club column (a value of 37 points), and a player has the queen and 7 of clubs on their rack, the player could play both card pieces on one turn and receive 54 points. The player could also just play the queen as one turn, receiving 47 points and the 7 on the next turn and receive 54 more points. However, another player could block where the 7 would be played or could place the appropriate wild card piece where the first player planned to play the 7.

Wild card pieces are suit specific and can be used only to form or build, but not to block, a Catena. A player must declare the value of the wild card when it is played. Wild card pieces have no point value, but the player receives the point value of all other card pieces formed or built by the wild card piece.

Preferably, the game includes a special wild card rule wherein a player has the option of using his or her turn to replace a played wild card piece with the actual card piece. The player receives no points for this play. The removed wild card piece is placed on the player's rack and can be used in a subsequent turn.

The game ends when there are no more card pieces in the bag or face down on the drawing surface and one player has placed all card pieces on game board 10. Players left with card pieces are to deduct the face value of the pieces. Ace card pieces, such as piece 36, are valued at 20 points. Face card pieces, such as piece 34, are valued at 10 points and wild card pieces, such as piece 38, are valued at 50 points.

In scoring the game, card pieces have the following values:

ace card pieces =20 points as ace or after king
1 point when placed before a 2
face card pieces=10 points
other card pieces=face value
wild card pieces=no value In adding up points each turn, it is possible for the placement of one card piece to form or extend more than one Catena. Should that occur the player receives the point value of all Catenas formed or extended.

While several embodiments of the present invention have been shown and described, it is to be understood that many changes and modifications may be made thereunto without departing from the spirit and scope of the invention.

What is claimed is:

1. A method of playing a board game among two or more players, comprising:

(a) providing at least fifty-six pieces representing the fifty-two cards in a standard playing card deck and at least four wild cards arranged in the standard playing card suits, at least one wild card for each suit;

(b) providing a game board having a flat playing surface of rectangular dimension, said board arranged in four columns, one column for each card suit, each column having fourteen squares for placement of the pieces;

(c) providing a plurality of racks for holding the pieces, one rack for each game player, each rack adapted to hold at least five pieces;

(d) placing the pieces with their faces hidden from each player and mixing the pieces up;

(e) each player selecting five pieces and placing the selected pieces on the rack for that player;

(f) each player, in clockwise rotation, placing at least one piece in an open board square having the same suit as the suit on the piece, said player placing up to five pieces in said open board squares to form either three or four of a kind or three or more of a run in a straight line horizontally, vertically or diagonally, with points being awarded in accordance with the following rules;

(i) each ace card piece has a value of twenty points when used as an ace or placed after a king card piece and a value of one point when placed before a two card piece;

(ii) each face card piece has a value of ten points;

(iii) each numbered card has its indicated value; and (iv) each wild card has no value.

2. A method according to claim 1 wherein the rules further provide:

(v) the game ends when there are no more card pieces for selection by a player and one player has placed all card pieces on the board; and (vi) players left with card pieces deduct the value of the pieces left from the player's points when the game ends except that ace card pieces are valued at twenty points and wild card pieces are valued at fifty points.

3. A method according to claim 1 wherein each player selects five pieces as follows:

(i) each player selects one piece;

(ii) the player with the highest piece value goes first and selects four more pieces; and (iii) each remaining player, in clockwise rotation, selects four more pieces.

4. A method according to claim 3 wherein if two players draw a card piece of the same high card piece value, the player with the highest suit will go first, the suits being ranked with spades having the highest suit value, then hearts, diamonds and clubs following in that order.

* * * * *